US008475244B2

(12) United States Patent
Wright

(10) Patent No.: US 8,475,244 B2
(45) Date of Patent: Jul. 2, 2013

(54) FUME HOOD HAVING V-SHAPED BAFFLE

(75) Inventor: Douglas Wright, Reminderville, OH (US)

(73) Assignee: Lincoln Global, Inc., City of Industry, CA (US)

( * ) Notice: Subject to any disclaimer, the term of this patent is extended or adjusted under 35 U.S.C. 154(b) by 940 days.

(21) Appl. No.: 12/573,546

(22) Filed: Oct. 5, 2009

(65) Prior Publication Data

US 2011/0081850 A1 Apr. 7, 2011

(51) Int. Cl.
*F24F 13/00* (2006.01)
*F24C 15/20* (2006.01)

(52) U.S. Cl.
USPC ..... 454/56; 126/299 D

(58) Field of Classification Search
USPC ..... 454/50–52, 56, 65, 67; 126/299 D, 126/301, 193, 312
See application file for complete search history.

(56) References Cited

U.S. PATENT DOCUMENTS

| | | | | |
|---|---|---|---|---|
| 3,604,333 | A | 9/1971 | Nelson | |
| 3,664,255 | A | 5/1972 | Kuechler | |
| 3,731,462 | A | 5/1973 | Costarella et al. | |
| 4,125,062 | A | 11/1978 | Eakes | |
| 4,134,331 | A | 1/1979 | Bender | |
| 4,744,305 | A | 5/1988 | Lim et al. | |
| 4,822,385 | A | 4/1989 | Strege et al. | |
| 5,211,159 | A | 5/1993 | Lieblein et al. | |
| 5,394,861 | A | 3/1995 | Stegmaier | |
| 5,558,080 | A | 9/1996 | Grohman et al. | |
| 6,543,526 | B2 * | 4/2003 | Jacobs | 165/144 |
| 7,318,771 | B2 * | 1/2008 | Huang et al. | 454/61 |
| 7,455,580 | B2 * | 11/2008 | Cheng | 454/50 |
| 2007/0281598 | A1 | 12/2007 | Huang et al. | |
| 2008/0092874 | A1 | 4/2008 | Kolecki | |

FOREIGN PATENT DOCUMENTS

| | | |
|---|---|---|
| EP | 0211784 | 2/1987 |
| FR | 2911520 | 7/2008 |
| WO | 2008090080 | 7/2008 |

OTHER PUBLICATIONS

International Search Report; Corresponding PCT Application No. PCT/IB2010/002509; Authorized Officer Devilers, Erick; dated Sep. 12, 2011 (3 pages).
Written Opinion; Corresponding PCT Application No. PCT/IB2010/002509; Authorized Officer Devilers, Erick; (3 pages).

* cited by examiner

*Primary Examiner* — Steven B McAllister
*Assistant Examiner* — Helena Kosanovic
(74) *Attorney, Agent, or Firm* — Pearne & Gordon LLP

(57) ABSTRACT

An elongated, cantilever baffle for a fume hood is provided. The baffle has a V-shaped bottom, including a right bottom portion and a left bottom portion that form a substantially horizontal edge. The baffle also has a substantially vertical left wall and a substantially vertical right wall. The substantially vertical left wall has a top edge and a bottom connected to the left bottom portion of the V-shaped bottom. The substantially vertical right wall has a top edge and a bottom connected to the right bottom portion of the V-shaped bottom.

15 Claims, 4 Drawing Sheets

FUME HOOD HAVING V-SHAPED BAFFLE

FIELD OF INVENTION

The present application relates to a fume hood. More particularly, the present application relates to a fume hood for an enclosed work station.

BACKGROUND

Fume hoods are used in laboratories, manufacturing environments, and other locations where technicians work with materials that generate fumes. A fume hood may take the form of an enclosure over a work surface, and be adapted for connection to a suitable air discharge system. Some hoods have been provided with an access opening which may be closed by a door or panel. Other fume hoods are configured to be attached to walls of a workstation, wherein the walls include an access opening which may be closed by a door or panel.

SUMMARY

An elongated, cantilever baffle for a fume hood is provided. The baffle has a V-shaped bottom, including a right bottom portion and a left bottom portion that form a substantially horizontal edge. The baffle also has a substantially vertical left wall and a substantially vertical right wall. The substantially vertical left wall has a top edge and a bottom connected to the left bottom portion of the V-shaped bottom. The substantially vertical right wall has a top edge and a bottom connected to the right bottom portion of the V-shaped bottom.

BRIEF DESCRIPTION OF THE DRAWINGS

In the accompanying drawings, structures are illustrated that, together with the detailed description provided below, describe exemplary embodiments of the claimed invention.

In the drawings and description that follows, like elements are identified with the same reference numerals. The drawings are not to scale and the proportion of certain elements may be exaggerated for the purpose of illustration.

DETAILED DESCRIPTION

Figure 1:
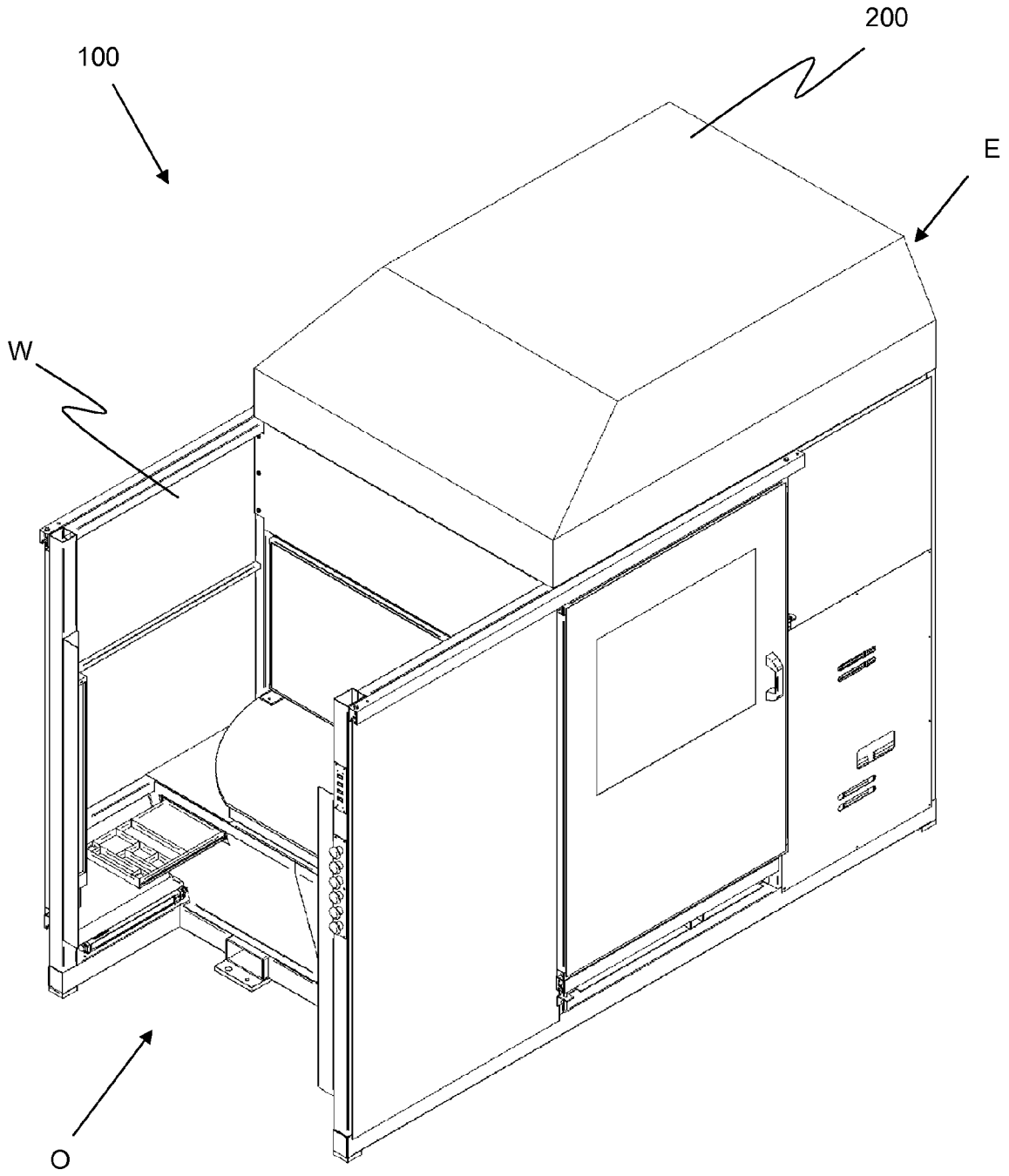
FIG. 1 is a perspective view of one embodiment of a fume hood attached to an exemplary work station.

FIG. 1 is a perspective view of an exemplary work station 100 with a plurality of walls W and one embodiment of a fume hood 200 mounted thereto. In the illustrated embodiment, the walls W of the work station 100 define two work areas. The fume hood 200 is mounted to four walls, forming an enclosed work area E. The walls W also form an open air work area O. It should be understood, however, that the fume hood 200 may be employed on a work station having any number of walls and any number of work areas. In an alternative embodiment (not shown), a single fume hood may be dimensioned to enclose two or more work areas. In another alternative embodiment (not shown), a work station may include two or more fume hoods.

In the illustrated embodiment, the work station 100 is an automated welding station that may also be referred to as a work cell. Welding is performed in the enclosed work area E by a robot, and preparation for welding is performed by an operator in the open air work area O. The operator may be a human or a robot. It should be understood, however, that the fume hood 200 is not limited to use in a welding environment. The fume hood 200 may be employed on any manufacturing or laboratory workstation, or in any other environment in which a fume hood is desired.

Figure 2:
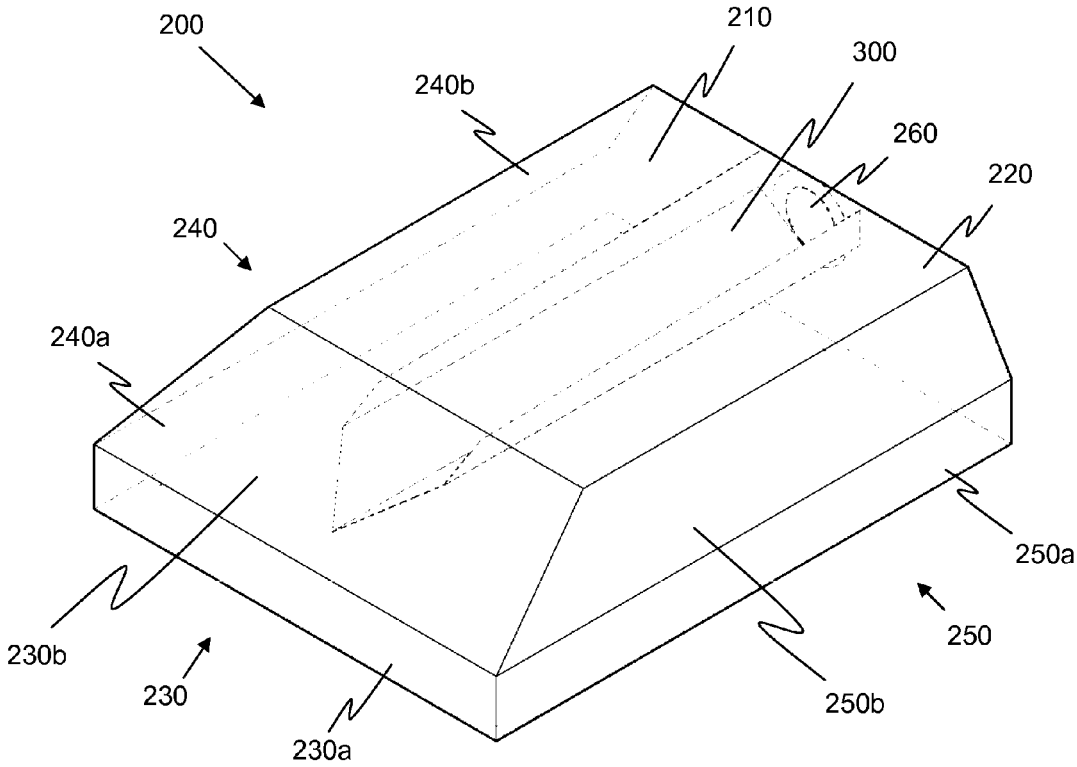
FIG. 2 is a perspective view of one embodiment of a fume hood 200.
Figure 4:
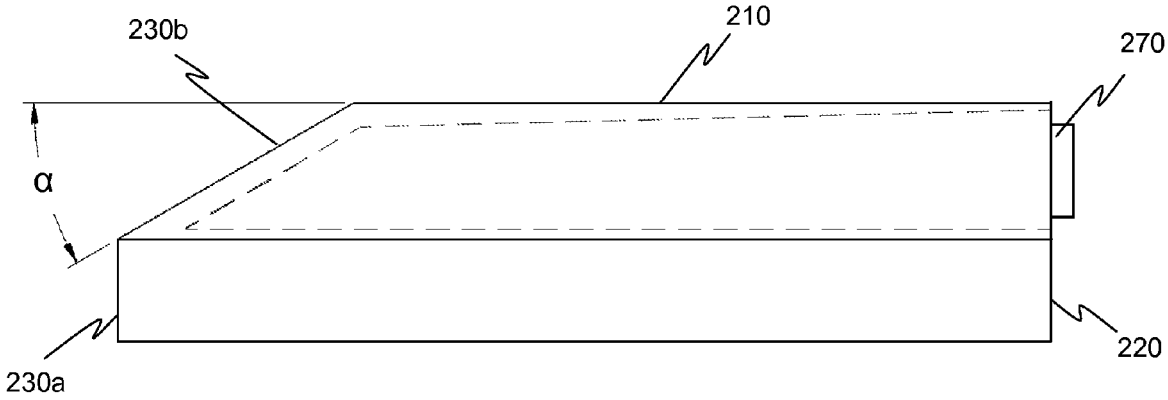
FIG. 4 is a side view of the fume hood 200.
Figure 3:
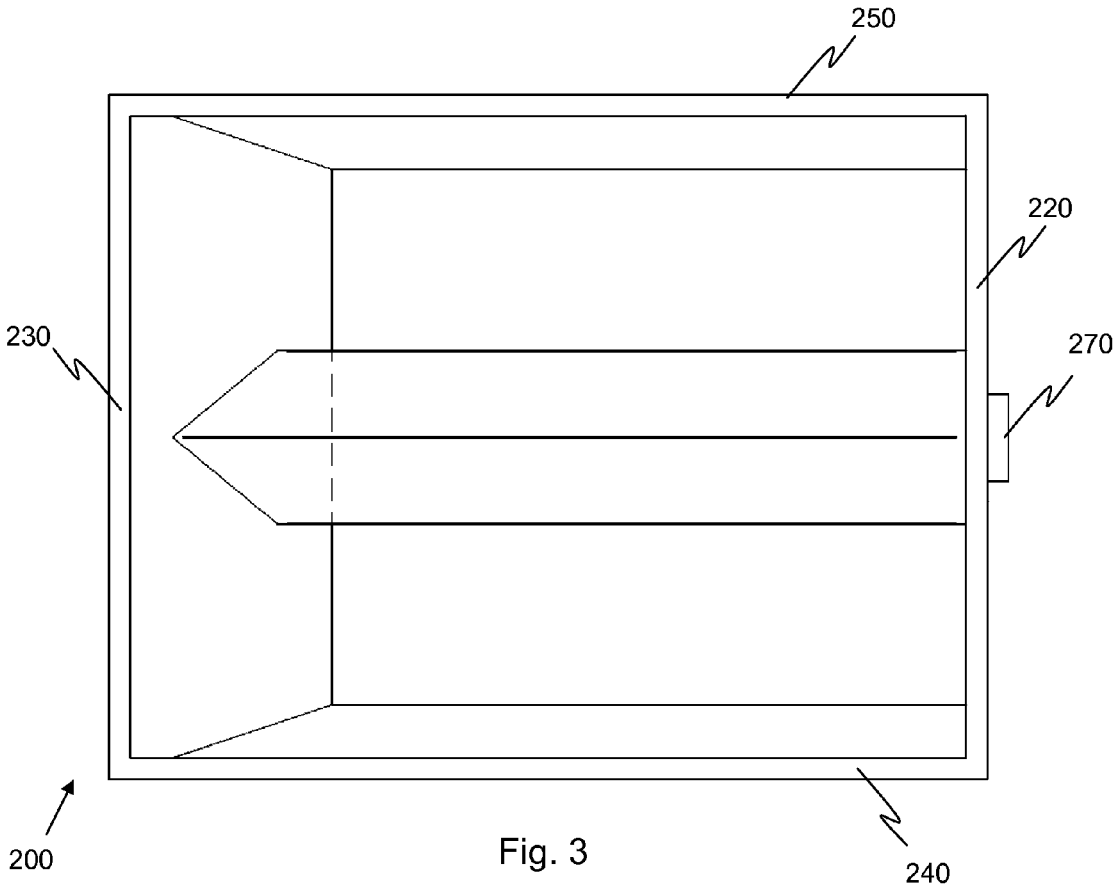
FIG. 3 is a bottom view of the fume hood 200.
Figure 5:
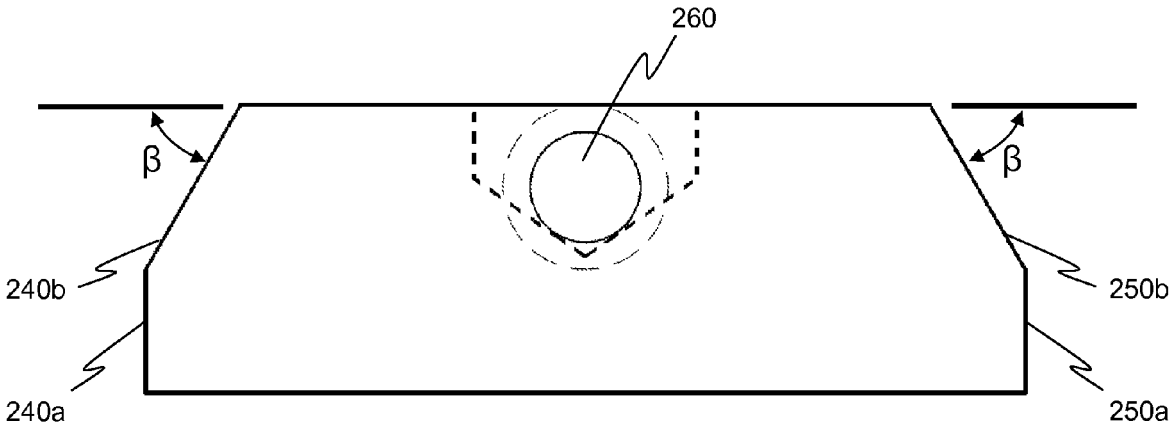
FIG. 5 is a rear view of the fume hood 200.

FIGS. 2-5 show different views of one embodiment of the fume hood 200. Specifically, FIG. 2 illustrates a perspective view, FIG. 3 illustrates a bottom view, FIG. 4 illustrates a side view, and FIG. 5 illustrates a rear view.

As best shown in FIG. 2, the fume hood 200 includes a ceiling 210 and a plurality of sidewalls. In the illustrated embodiment, the ceiling is substantially horizontal. In alternative embodiments (not shown), the ceiling may be angled, concave, or convex. The angle or curve of the ceiling may be selected according to space restrictions, or may be selected for other reasons, such as improved functionality or aesthetics.

The plurality of sidewalls include a rear wall 220, a front wall 230, a right wall 240, and a left wall 250. However, it should be understood that the fume hood 200 may have any number of sidewalls.

As can be seen in the bottom view shown in FIG. 3, the rear wall 220, front wall 230, right wall 240, and left wall 250 form a substantially rectangular footprint. In alternative embodiments (not shown), the fume hood may have a triangular, trapezoidal, pentagonal, hexagonal, circular, semi-circular, or any geometric footprint. The footprint of the fume hood 200 may be selected to accommodate the geometry of the workstation 100. The geometry of the workstation may be selected for a variety of reasons, including, but not limited to, optimization of workspace, cost efficiencies, or aesthetics. The workstation may also be dimensioned to include multiple work zones, and the fume hood may be dimensioned to cover one or more work zones.

With reference back to FIG. 2, the rear wall 220 of fume hood 200 is substantially vertical and has a substantially uniform thickness. In alternative embodiments (not shown), the rear wall 220 may angled, beveled, concave, convex, or have a non-uniform thickness. The angle or curve of the rear wall 220 may be selected according to space restrictions, or may be selected for other reasons, such as aesthetics. In one known embodiment, one or more walls and/or the ceiling may be angled to direct fume toward a desired location, such as towards a baffle or towards an outlet.

In the illustrated embodiment, the front wall 230 is beveled and includes a substantially vertical front portion 230*a* and a beveled front portion 230*b*, with both portions having a substantially uniform thickness. As best shown in the side view of FIG. 4, the beveled front portion 230*b* slopes downward at an angle $\alpha$. In one embodiment the angle $\alpha$ is between 30° and 75°. In one particular embodiment, the angle $\alpha$ is about 30°. In alternative embodiments (not shown), the front wall 230 may angled, concave, or convex. The angle or curve of the front wall 230 may be selected according to space restrictions, or may be selected for other reasons, such as aesthetics.

As can be seen in FIG. 2, the right wall 240 is also beveled and includes a substantially vertical right portion 240*a* and a beveled right portion 240*b*, with both portions having a substantially uniform thickness. Likewise, the left wall 250 is beveled and includes a substantially vertical left portion 250*a* and a beveled left portion 250*b*, with both portions having a substantially uniform thickness. With reference now to the rear view of the fume hood 200 shown in FIG. 5, right wall 240 and left wall 250 are substantially symmetrical, and the beveled right portion 240*b* and beveled left portion 250*b* both slope downward at an angle β. In one embodiment the angle β is between 30° and 75°. In one particular embodiment, the angle β is about 60°. In an alternative embodiment (not shown), the right wall 240 and left wall 250 are asymmetrical and have beveled portions that slope downward at different angles. In other alternative embodiments (not shown), the right wall 240 and left wall 250 may angled, concave, or convex. The angles or curves of the right wall 240 and left wall 250 may be selected according to space restrictions, or may be selected for other reasons, such as aesthetics.

The fume hood 200 further includes an aperture 260 disposed in one of the plurality of sidewalls. In the illustrated embodiment, the aperture 260 is disposed in the rear wall 220. In alternative embodiments (not shown), the aperture may be disposed in the front wall, right wall, or left wall. In another alternative embodiment (not shown), the aperture may be disposed in the ceiling. In yet another alternative embodiment (not shown), the fume hood may include two or more apertures disposed therein.

As can be seen in the side view of FIG. 4, the aperture 260 is surrounded by an outwardly extending flange 270. The flange 270 may be configured for connection with a duct (not shown) by any known connection method, including, without limitation, snap fit, threaded fit, press fit, or with the use of fasteners. In an alternative embodiment (not shown), the aperture 260 does not include a flange.

Figure 6:
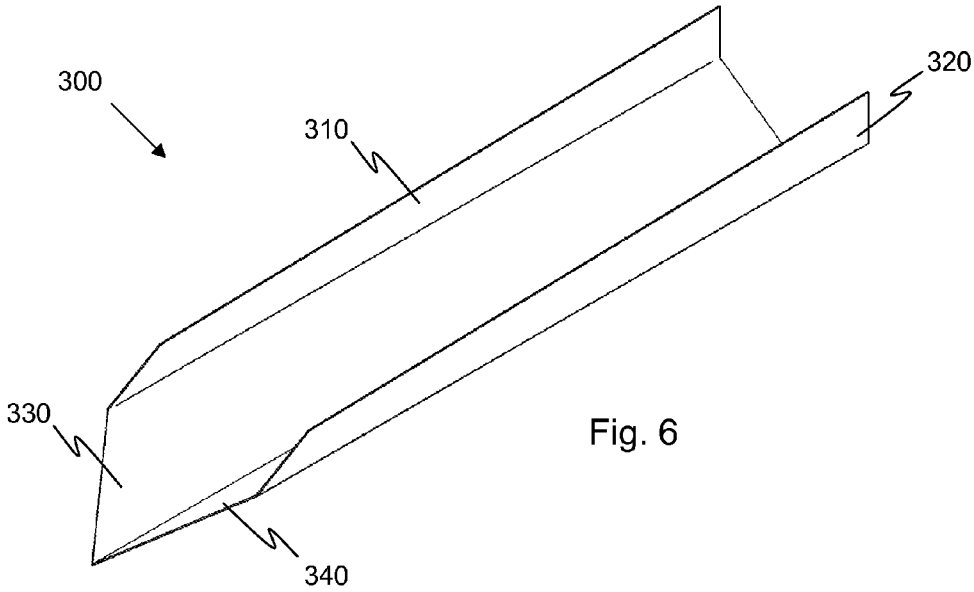
FIG. 6 is a perspective view of one embodiment of a baffle 300 for a fume hood.
Figure 7:
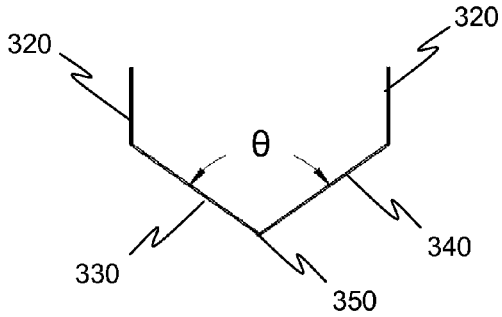
FIG. 7 is a front view of the baffle 300.
Figure 8:
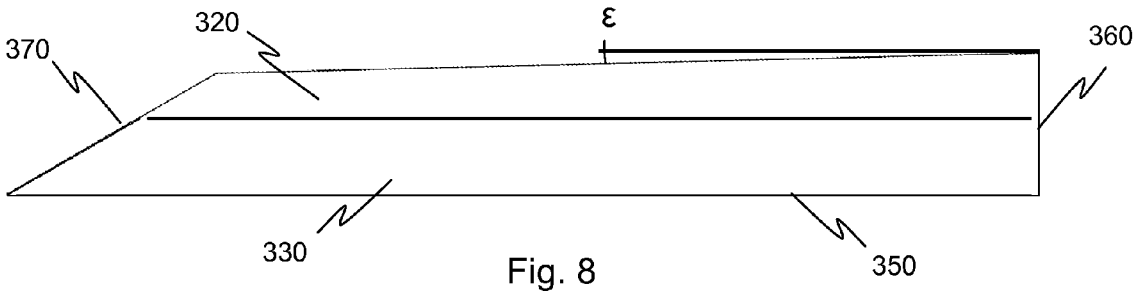
FIG. 8 is a left side view of the baffle 300.

In the illustrated embodiments, fume hood 200 includes an elongated, cantilevered baffle 300 extending from the rear wall 220. FIGS. 6-8 show different views of one embodiment of the baffle 300. Specifically, FIG. 6 illustrates a perspective view, FIG. 7 illustrates a front view, and FIG. 8 illustrates a left side view.

As best seen in FIGS. 6 and 7, the baffle 300 includes a pair of substantially vertical sidewalls, including an upper right wall 310 having a top edge and an upper left wall 320 having a top edge that is substantially coplanar with the top edge of the upper right wall. In the illustrated embodiment, the upper right wall 310 and upper left wall 320 of the baffle 300 are both substantially vertical and have substantially uniform thickness. In alternative embodiments (not shown), the upper right wall and upper left wall of the baffle may be angled inwardly or outwardly. In other alternative embodiments (not shown), the upper right wall and upper left wall of the baffle may be concave or convex. In still other alternative embodiments (not shown), the upper right wall and upper left wall of the baffle may be omitted.

In the illustrated embodiment, the baffle 300 further includes a V-shaped bottom, including a right bottom portion 330 connected to the upper right wall 310 and a left bottom portion 340 connected to the upper left wall 320. The right bottom portion 330 and the left bottom portion 340 are joined to form a substantially horizontal edge 350. The right bottom portion 330 is disposed at an angle θ with respect to the left bottom portion 340. In one embodiment the angle θ is between 90° and 150°. In one particular embodiment, the angle θ is about 110°.

The upper right wall 310, the upper left wall 320, and the V-shaped bottom (i.e., right bottom portion 330 and left bottom portion 340), form a back edge 360 along a substantially vertical plane. In alternative embodiments (not shown), the back edge 360 may angled, beveled, concave, or convex.

Additionally, the upper right wall 310, the upper left wall 320, and the V-shaped bottom (i.e. right bottom portion 330 and left bottom portion 340), form an angled front end 370. In one embodiment, the front end is disposed at an angle corresponding to the downward angle α the beveled front portion 230*b* of the front wall 230 of the fume hood 200. In alternative embodiments (not shown), the front end 370 may be angled, beveled, concave, or convex.

As best shown in FIG. 8, the top edge of the upper right wall 310 and the top edge of the upper left wall 320 slope downward from the back edge 360 of the baffle 300 at an angle ϵ towards the front end of the baffle 300. In one embodiment, the angle ϵ is between 0° and 20°. In one particular embodiment, the angles is about 1.4°.

With reference back to FIG. 2, the baffle 300 is connected to the rear wall 220 and positioned such that the aperture 260 of the rear wall 220 is disposed between the upper right wall 310 and the upper left wall 320 of the baffle 300, between the right bottom portion 330 and the left bottom portion 340 of the baffle 300.

In one embodiment, the back edge 360 of the baffle 300 is riveted to the rear wall 220 of the fume hood 200. In alternative embodiments, the back edge of the baffle may be connected to the rear wall of the fume hood by welding, by fasteners, by adhesive, by a snap fit, or by a press fit.

In the illustrated embodiment, the baffle 300 is positioned such that a gap is formed between the ceiling 210 of the fume hood 200 and the top edges of the upper right wall 310 and upper left wall 320 of the baffle 300. In an alternative embodiment (not shown), at least a portion of the baffle contacts the ceiling of the fume hood.

The gap between the ceiling 210 and the top edges of the upper right wall 310 and upper left wall 320 of the baffle 300 increases from the back edge 360 of the baffle 300 towards the front end 370 of the baffle 300. In one embodiment, the gap increases from 1 centimeter to 4 centimeters. This varying gap between a top edge of a baffle and a ceiling of a fume hood, alone or in combination with the V-shape of the baffle 300, creates a Venturi effect to move air towards the aperture 260.

In the illustrated embodiment, the baffle 300 extends substantially across the length of the fume hood 200 without contacting the front wall 230 of the fume hood 200. In an alternative embodiment (not shown), at least a portion of the baffle may contact the front wall.

In one embodiment, the ceiling, sidewalls, and the baffle are all constructed of the same material. For example, the baffle 300 may be cut from a single sheet of material, and the upper right wall 310, the upper left wall 320, the right bottom portion 330, and the left bottom portion 340 may be formed by folding the cut sheet of material. Alternatively, the upper right wall 310, the upper left wall 320, the right bottom portion 330, and the left bottom portion 340 may be separate components that are connected to each other by welding, by riveting, by fasteners, by adhesive, by a snap fit, or by a press fit.

In an alternative embodiment, different components may be constructed of different materials. In such an embodiment, the upper right wall 310, the upper left wall 320, the right bottom portion 330, and the left bottom portion 340 may be separate components that are connected to each other by welding, by riveting, by fasteners, by adhesive, by a snap fit, or by a press fit.

In one embodiment, the ceiling, sidewalls, and the baffle are constructed of a lightweight material. For example, in one known embodiment, the fume hood weighs less than 20 kilograms. The material may also be a sound dampening material.

In one particular embodiment, the ceiling, the plurality of sidewalls, and the baffle are constructed of a composite of polyethylene and aluminum. Such composite material is commercially available under the brand names DIBOLD and ALUCOBOND.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A fume hood configured to be connected to a work station having a plurality of walls, the fume hood comprising:
- a ceiling;
- a plurality of sidewalls, including a rear wall having an aperture disposed therein; and
- a baffle having:
  - a pair of substantially vertical upper walls, including an upper right wall having a top edge and an upper left wall having a top edge that is substantially coplanar with the top edge of the upper right wall, and
  - a V-shaped bottom, including a right bottom portion connected to the upper right wall and a left bottom portion connected to the upper left wall,
- wherein the baffle is connected to the rear wall and positioned such that the aperture of the rear wall is disposed between the right sidewall and the left sidewall of the baffle, and
- wherein the baffle is positioned such that a gap is formed between the ceiling and the top edges of the upper right wall and upper left wall of the baffle.

2. The fume hood of claim 1, wherein the baffle extends substantially across the length of the fume hood, without contacting a front wall of the fume hood.

3. The fume hood of claim 1, wherein the right bottom portion of the baffle is disposed at an angle of between 90° and 150° with respect to the left bottom portion of the baffle.

4. The fume hood of claim 1, wherein the gap between the ceiling and the top of the baffle increases from a rear of the baffle towards a front of the baffle.

5. The fume hood of claim 1, wherein the plurality of sidewalls includes a front wall, the font wall including a substantially vertical portion and a beveled portion.

6. The fume hood of claim 5, wherein the baffle has a front end disposed at an angle corresponding to the beveled portion of the front wall.

7. The fume hood of claim 1, wherein the ceiling, the plurality of sidewalls, and the baffle are constructed of the same material.

8. The fume hood of claim 7, wherein the ceiling, the plurality of sidewalls, and the baffle are constructed of a composite of polyethylene and aluminum.

9. The fume hood of claim 1, wherein the baffle is connected to the rear wall by rivets.

10. A fume hood configured to be connected to a work station having a plurality of walls, the fume hood:
- a ceiling; and
- a sidewall having an aperture disposed therein; and
- a baffle comprising:
- a V-shaped bottom, including a right bottom portion and a left bottom portion that form a substantially horizontal edge;
- a substantially vertical left wall having a top edge and a bottom connected to the left bottom portion of the V-shaped bottom; and
- a substantially vertical right wall having a top edge and a bottom connected to the right bottom portion of the V-shaped bottom,
- wherein the V-shaped bottom, the substantially vertical left wall, and the substantially vertical right wall form a substantially vertical back edge, and
- wherein the top edge of the left wall and the top edge of the right wall slope downward from the back edge of the baffle towards a front end of the baffle; and
- wherein the baffle is positioned such that the aperture of the sidewall of the fume hood is located interior of the substantially vertical back edge of the baffle.

11. The fume hood baffle of claim 10, wherein the top edge of the left wall and the top edge of the right wall slope downward from the back edge of the baffle at an angle between 0° and 20°.

12. The fume hood of claim 10, wherein the front end of the baffle is angled downward.

13. The fume hood of claim 10, wherein the front end of the baffle is angled downward at an angle between 30° and 75°.

14. The fume hood of claim 10, wherein the right bottom portion of the V-shaped bottom and the left bottom portion of the V-shaped bottom form an angle of between 90° and 150°.

15. The fume hood of claim 10, wherein the right bottom portion, the left bottom portion, the upper right wall, and the upper left wall, are formed from a single sheet of a composite of polyethylene and aluminum.

* * * * *

UNITED STATES PATENT AND TRADEMARK OFFICE

CERTIFICATE OF CORRECTION

PATENT NO. : 8,475,244 B2
APPLICATION NO. : 12/573546
DATED : July 2, 2013
INVENTOR(S) : Wright It is certified that error appears in the above-identified patent and that said Letters Patent is hereby corrected as shown below:

In the specification, column 4, line 14, please delete “angles” and add -- angle ε --

In the claims, column 6, line 7, claim 5, please delete “font” and add -- front --

In the claims, column 6, line 21, claim 10, add -- comprising -- after “hood”

Signed and Sealed this
Twenty-fourth Day of September, 2013

Teresa Stanek Rea
*Deputy Director of the United States Patent and Trademark Office*